US005633900A

United States Patent [19]

Hassal

[11] Patent Number: 5,633,900

[45] Date of Patent: May 27, 1997

[54] METHOD AND APPARATUS FOR PRODUCTION OF RADIOACTIVE IODINE

[76] Inventor: Scott B. Hassal, 79 Bond Street North, Hamilton, Ontario, Canada, L8S 3W4

[21] Appl. No.: 130,726

[22] Filed: Oct. 4, 1993

[51] Int. Cl.[6] ..... G21G 1/06

[52] U.S. Cl. ..... 376/189; 376/169; 423/249; 422/159

[58] Field of Search ..... 376/168, 169, 376/189, 195, 201

[56] References Cited

U.S. PATENT DOCUMENTS

| | | | |
|---|---|---|---|
| 4,622,201 | 11/1986 | Robertson et al. | 376/192 |
| 4,664,869 | 5/1987 | Mirzadeh et al. | 376/195 |
| 4,729,903 | 3/1988 | McGovern et al. | 376/189 |

FOREIGN PATENT DOCUMENTS

| | | | |
|---|---|---|---|
| 1026213 | 4/1966 | United Kingdom | 376/169 |

OTHER PUBLICATIONS

Radiation Research Society of Isreal 1980, Trans. v. 8, Conf: Isreal Nuclear Societies Joint Annual Meeting, pp. 175, 176, Pasi et al.

Nukleonika, vol. 14, No. 7–8, (1969), pp. 825–830, Ludziejewski: et al.

Isotopes Radiation Technol., vol. 1, No. 2, (Winter 1963–64), pp. 143–146.

ORNL—3840, (Jan. 1966), Case et al. pp. 1–13.

Int. J. of Applied Radiation and Isotopes, (1976), vol. 27, pp. 357–363, Langstrom et al.

Int. J. of Applied Radiation and Isotopes, vol. 31, pp. 163–167, Adilbish et al, (1980).

Appl. Radiat. Isot., vol. 37, No. 11, pp. 1135–1139, (1986), Blessing et al.

Nuclear Instruments and Methods, vol. 79, No. 2, (1970), pp. 333–340, Lundan et al.

Journal of Inorganic and Nuclear Chemistry, vol. 30, No. 10, 1968, UK pp. 2577–2581—Qaim et al. "Half-Lives and Activation Cross-Sections of Some Radio-Isotopes of Iodine, Tellurium and Antimony Formed in the Interaction of Iodine with 14.7 MeV Neutrons".

International Journal of Applied Radiation and Isotopes, vol. 35, No. 10, 1984, UK pp. 933–938 Marthino et al "I-125 Production: Neutron Irradiation Planning".

*Primary Examiner*—Harvey E. Behrend

*Attorney, Agent, or Firm*—Sim & McBurney

[57] ABSTRACT

Iodine-125 is produced by neutron irradiation of $^{124}$Xe gas to form $^{125}$Xe and permitting decay of $^{125}$Xe to form $^{125}$I. Irradiation of the xenon-124 is effected in a first chamber within an enclosure and decay is effected in a second chamber within the enclosure and free from neutron flux. The apparatus is submersible in a nuclear reactor pool so as to absorb any radiation escaping the apparatus during the process. Xenon can be caused to move between the chambers remotely, underwater. The second chamber is removable from said enclosure and is transported to a suitable location to recover the $^{125}$I from its interior. Such recovery is effected by admitting an aqueous wash solution into the second chamber, whereupon it is heated, causing water from the wash solution to reflux and cleanse the interior surfaces of the second chamber, thus creating an aqueous solution of $^{125}$I, which then is caused to drain into a suitable container.

7 Claims, 3 Drawing Sheets

METHOD AND APPARATUS FOR PRODUCTION OF RADIOACTIVE IODINE

FIELD OF INVENTION

The present invention relates to the production of radioactive iodine and, in particular, to a novel procedure and apparatus for effecting the same on a large scale in safety.

BACKGROUND TO THE INVENTION

Iodine-125 ($^{125}I$) is a radioactive isotope of iodine with a relatively long half-life of 60 days. This material is used for medical diagnostic studies and for medical and biological research. This iodine isotope is valuable because the radiation it emits is less damaging than that from other isotopes of iodine.

It is known to produce such material by irradiating $^{124}Xe$ with thermal neutrons, according to the following scheme:

$$^{124}Xe \xrightarrow{(n,\gamma)} {}^{125}Xe \xrightarrow[17\,h]{(\beta,\gamma)} {}^{125}I$$

$^{125}I$ decays to form $^{125}Te$ or may be converted to $^{126}I$ which decays to $^{126}Te$, as follows:

$$\begin{array}{ccc} {}^{125}I & \xrightarrow[60\,d]{(\beta,\gamma)} & {}^{125}Te \\ (n,\gamma)\downarrow & & \\ {}^{126}I & \xrightarrow[13\,d]{(\beta,\gamma)} & {}^{126}Te \end{array}$$

Supplies of $^{125}I$ isotope are limited and there is an increasing demand for this material. Iodine-126 that is present with $^{125}I$ is a contaminant. Because of the emission of more damaging radiation by $^{126}I$, the Food and Drug Administration, U.S.A., requires that $^{125}I$ for use in the human body contains less than 5 parts per million of $^{126}I$.

SUMMARY OF INVENTION

The present invention provides a novel method and apparatus for the production of $^{125}I$, which is amenable to large-scale production. The procedure is effected on a batch basis with $^{124}Xe$ gas being irradiated periodically with a neutron flux over a period of time and permitting $^{125}Xe$ so provided to be transferred remotely and in safety to a different portion of the apparatus, where the $^{125}Xe$ decays to form $^{125}I$. For example, for a one-week cycle, approximately 5 g of $^{124}Xe$ gas is irradiated for up to about 15 hours a day for three to five days in a flux of approximately $5\times10^{12}$ neutrons $cm^{-2}\ s^{-1}$, to produce about 0.3 TBq (8 Ci) of $^{125}I$ which is free from $^{126}I$.

The quantity of $^{125}I$ can be increased by irradiating larger amounts of $^{124}Xe$ or by locating the apparatus in a higher flux. The upper limit of production of $^{125}I$ using the batch procedure of the present invention is about 0.74 TBq (20 Ci) of $^{125}I$ per batch, by employing a suitable combination of target amount, neutron flux and irradiation time.

Limits of the individual parameters of the process are irradiating up to 6 g of $^{125}Xe$, using fluxes of up to $2\times10^{13}$ neutrons $cm^{-2}\ s^{-1}$ and irradiating for up to five 15-hour days.

In one aspect, the present invention provides a method of producing radioactive $^{125}I$, which comprises feeding $^{124}Xe$ from a source thereof to an irradiation zone located within an enclosure, irradiating the $^{124}Xe$ in the enclosure with neutrons to cause the formation of $^{125}Xe$ therefrom, transferring irradiated gas from the irradiation zone to a decay zone within the enclosure and free from neutron flux, and permitting $^{125}Xe$ to decay to form $^{125}I$ in the decay zone. The location of the decay zone free from neutron flux ensures that the $^{125}I$ is produced free from $^{126}I$.

The invention also includes an apparatus for producing radioactive $^{125}I$ comprising a housing which is gas-tight and submersible in a nuclear reactor water pool and defining an interior chamber, the housing having upper and lower separable portions to permit access to the interior chamber. A first enclosure is provided within the chamber and is arranged to permit neutron irradiation of $^{124}Xe$ contained therein by the nuclear reactor. A second removable enclosure is provided within the chamber and is connected in interruptible fluid flow relationship with the first enclosure for transfer of irradiated xenon gas from the first enclosure to the second enclosure to permit decay of $^{125}Xe$ to $^{125}I$ in the second enclosure free from neutron flux. The second enclosure has valved inlet/outlet port means to permit $^{124}Xe$ to be received into the apparatus, to permit $^{125}I$ solution to be discharged from the second enclosure, and to permit the passage of xenon gas between the first and second chambers.

First pump means is operably connected to the first enclosure for precipitating $^{124}Xe$ received into apparatus through the valved port means when the first and second enclosures are in fluid flow relationship and for providing gaseous xenon in the first enclosure when the first and second enclosures are out of fluid flow relationship. Second pump means is operably connected to the second enclosure for precipitating irradiated xenon received from the first enclosure when the first and second enclosures are in fluid flow relationship and for providing gaseous irradiated xenon in the second enclosure when the first and second enclosures are out of fluid flow relationship.

DESCRIPTION OF PREFERRED EMBODIMENT

Figure 1:
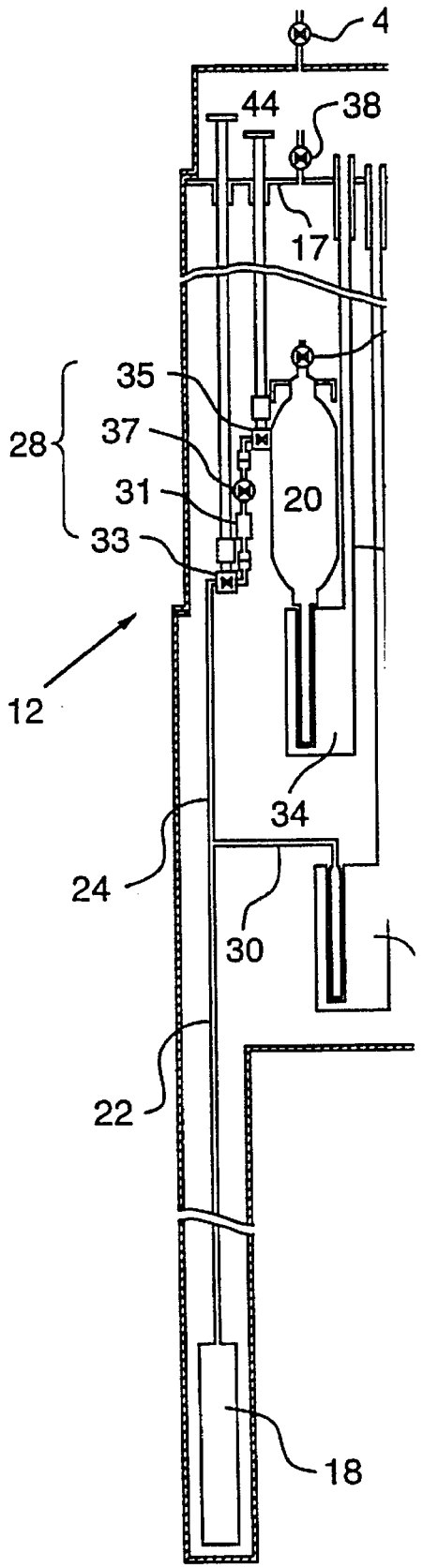
FIG. 1 is a schematic representation of a submersible apparatus for effecting the process of the present invention.

Referring to the drawings, FIG. 1 shows a submersible apparatus 10 which is constructed with provides double containment of materials, except during the interchange of the decay chamber as outlined below. The construction of the submersible apparatus 10 is all metal, welded wherever possible, and employs O-ring seals, so as to be air- and water-tight. The submersible apparatus 10 is used to irradiate $^{124}Xe$ in one container, to transfer the resulting $^{125}Xe$ to a separate container for decay to $^{125}I$ free from neutron flux and to reload the $^{124}Xe$ for additional irradiations.

The apparatus 10 includes an outer housing 12 which encloses the remaining elements of the apparatus. The outer housing 12 includes a lower fixed housing portion 14 and an upper removable housing portion 16. The lower housing portion 14 is the anchor point for all the structural connections to the other components. In particular, a stage (not shown) secures two cryopumps 32, 34, while filler tubes 40, 42 and extended valve handles 44 connect the lower housing portion 14 to the bulkhead 17 and hold the latter in place. The upper housing portion 16 seals with both the bulkhead 17 and the lower housing portion 14 to provide for double containment of radioactive materials. The upper housing portion 16 is removable from the lower housing portion 14 to permit decay chamber interchange.

Within the housing 12 is located an irradiation chamber 18 in which $^{124}Xe$ is subjected to neutron irradiation from any convenient source, such as a nuclear reactor, and a decay chamber 20 in which the $^{125}Xe$ can decay to $^{125}I$ free from neutron flux. The aforementioned chambers 18, 20 are connected via tubes 22, 24 and can be isolated and/or separated from each other by means of a valve mechanism 28. The valve mechanism is described in more detail below with respect to FIG. 2, and may include an optional getter trap.

The irradiation chamber 18 is connected via pipes 22 and 30 to a condenser and cold cell structure 32, which constitutes a cryopump. Similarly, the decay chamber 20 is connected (in this case directly) to a condenser and cold cell structure 34, which also constitutes a cryopump. These cryopumps permit irradiated xenon to be transferred from the irradiation chamber 18 to the decay chamber 20 and decayed xenon to be reloaded from the decay chamber 20 into the irradiation chamber 18. When irradiated xenon is transferred from the irradiation chamber 18 to the decay chamber 20, the optional getter trap associated with valve mechanism 28 captures any volatile iodine which may be carried along with the irradiated xenon. In addition, the optional getter trap can improve the efficacy of the cryopumping process by reducing the partial pressure due to non-condensible gases that are formed during the irradiation. For each cryopump 32, 34, the condenser slides into a sleeve in the cold cell, thus effecting good thermal contact while preserving true double containment, and allowing the decay chamber 20 to be removed from the remainder of the apparatus readily.

The decay chamber 20 includes a main valved connector 36 to permit initial evacuation and periodic removal of any non-condensible gases that are not captured by the optional getter trap. A sniffer port 38 is provided in the bulkhead 17 to permit sampling of the gas inside the housing 12 to ensure an absence of leaks within the system. Filler tubes 40, 42 penetrate the bulkhead 17 to permit remote filling and emptying of the cold cell portion of the cryopumps 32, 34 with liquid nitrogen. Filling of the cold cells with liquid nitrogen may be achieved by connecting a supply tube to a pressurized liquid nitrogen container and inserting the supply tube through the appropriate filler tube 40, 42 to the bottom of the cold cell. Liquid nitrogen levels may be checked with by using thermocouples positioned within the cold cell, or by observing the exhaust from the mouth of the filler tube.

Extended valve handles 44 passing through the bulkhead 17 permit remote operation of the disconnect valve mechanism 28. The penetration of the valve handles 44 through the bulkhead employs rotating seals in order to maintain containment. The valve mechanism 28 comprises two valves 33, 35 that can be remotely actuated, and an optional getter trap 31 located between the valves 33, 35 and which includes an integral valve 37. The upper remotely actuated valve 35 is integral to the decay chamber 20, and has a face-seal disconnect that joins it to valve 37, if the trap is included, or to the lower remotely actuated valve 33, if the trap is excluded. The disconnect allows the decay chamber 20 to be separated from the rest of the apparatus during decay chamber interchange, as described below. If the optional getter trap 31 is included, the valve 37 is left open, except during the decay chamber interchange, when the valve 37 is closed in order to prevent air from entering the getter trap 31 and deactivating the getter. The getter is a material that absorbs certain gases, including hydrogen, oxygen, nitrogen and iodine, while not affecting noble gases, such as xenon. Prior to its first use, and periodically thereafter, the getter requires activation, which is achieved by heating to an elevated temperature for a period of time in vacuum or under an inert gas atmosphere.

A top cap 46, which seats on the upper housing 16, serves to prevent water from entering the cold-cell portion of the cryopumps 32, 34 while the apparatus 10 is maintained submersed in the reactor pool and to provide redundant encapsulation for all the bulkhead welds, fittings and seals. The top 46 is removable for reloading and transfer operations and is provided with a sniffer port 48, which permits radioactive-gas leaks to be detected safely.

The submersible apparatus 10 is kept generally in the pool of a light-water nuclear reactor. The apparatus 10 may be submerged completely and positioned adjacent to the reactor core, in order to effect neutron irradiation of the irradiation chamber 18, or may be partially submerged to a greater or lesser extent adjacent to the edge of the reactor pool, in order to perform other operations.

Figure 2:
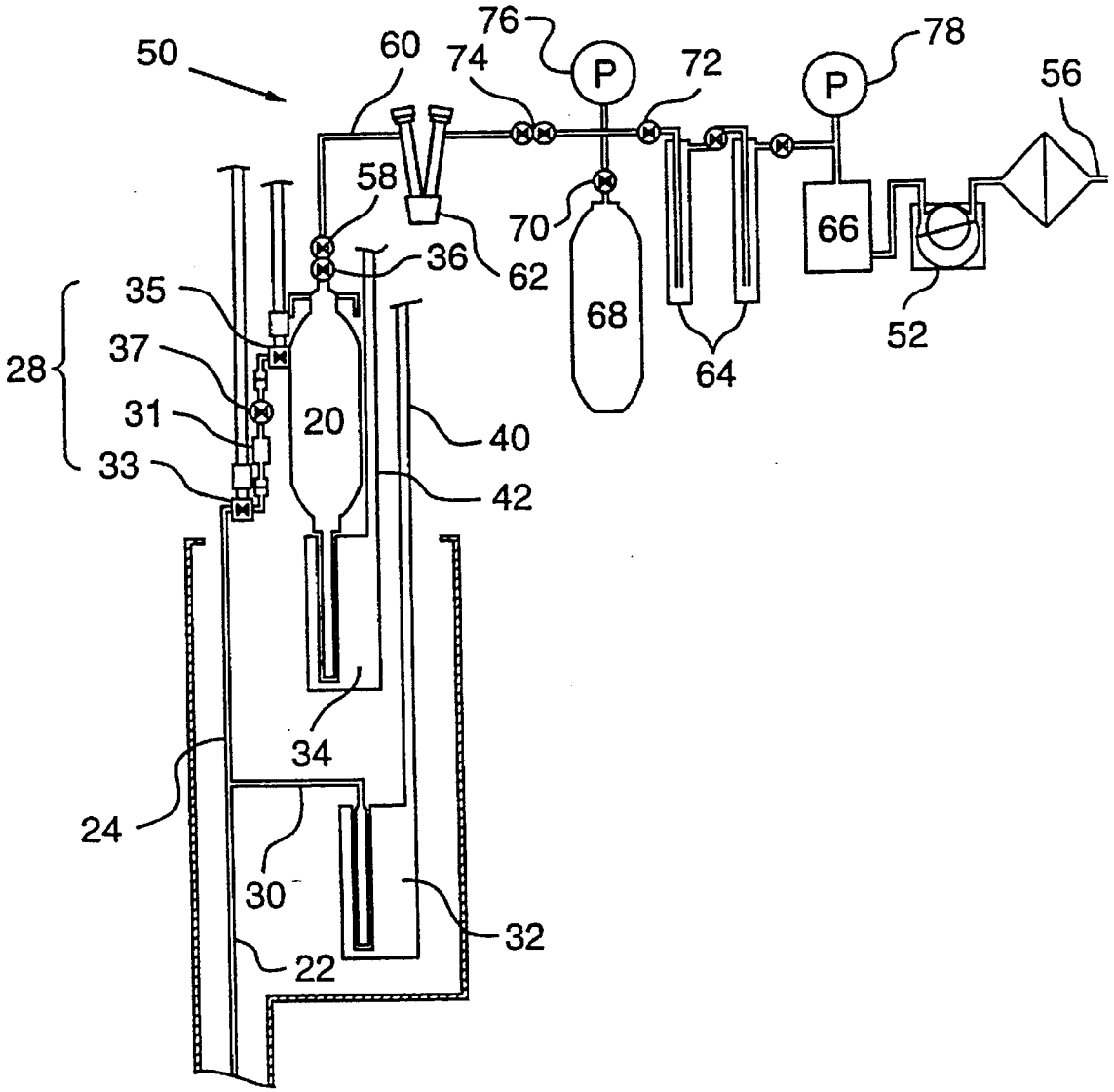
FIG. 2 is a schematic representation of the gas-handling system associated with the submersible apparatus shown in FIG. 1.

FIG. 2 shows a gas handling and vacuum station 50 employed with the submersible apparatus 10 of FIG. 1. The gas handling and vacuum station 50 is used to evacuate the submersible apparatus initially, to add or remove $^{124}Xe$ and to remove permanent gases from the system, as required.

The gas handling and vacuum station 50 includes a rotary vacuum pump 52, which exhausts through an activated charcoal filter 54 to an exhaust line 56. A diffusion pump 66 is connected to the inlet of the rotary vacuum pump 52. The inlet of the diffusion pump 66 is ultimately connected to the main valved connector 36 of the decay chamber 20, via a valve 58, a flexible tube 60, a dry-ice trap 62 and liquid-nitrogen traps 64. The main valved connector 36 and the valve 58 are joined with face-seal fittings, and constitute a double-valved disconnect. A similar disconnect 74 is provided between the dry ice trap 62 and the liquid nitrogen traps 64.

A $^{124}Xe$ storage cylinder 68 is connected between the dry-ice trap 62 and the liquid-nitrogen traps 64 by a valve 70. During the initial evacuation of the gas-wetted portions of the submersible apparatus 10 by the diffusion pump 66 and rotary vacuum pump 52, the valve 70 is closed. Xenon-124 is added to the apparatus by first closing valve 72 and then opening valve 70 to permit the desired amount of $^{124}Xe$ to enter the evacuated apparatus through disconnect 74, dry-ice trap 62, flexible tube 60, valve 58 and main valved connector 36.

When the required amount of $^{124}Xe$ has been loaded, valve 70 is closed and the $^{124}Xe$ is cryopumped into the condenser of the lower cryopump 32 in the submersible apparatus 10, whereupon the two remotely-actuated valves 33, 35 of the valve mechanism 28 are closed and the lower cryopump 32 is warmed to room temperature, thus causing the $^{124}Xe$ to evaporate and expand to fill the irradiation chamber 18, and the connecting tubes 22, 24 and 30. Xenon is removed from the submersible apparatus 10 by cooling the storage cylinder 68 with liquid nitrogen while valve 72 is closed so that the xenon condenses within the storage cylinder 68.

The dry-ice trap 62 serves to capture any volatile iodine and is checked routinely to ensure that iodine that is formed in the apparatus exists in a bound state. The dry-ice trap 62 includes two quartz windows, being relatively transparent to the gamma emissions of $^{125}I$, and is of such a design that any $^{125}I$ so captured within the cold volume of the dry-ice trap 62 is detectable noninvasively by means of a suitable detector that is positioned alternately adjacent to such windows. The liquid nitrogen trap 64 captures any xenon that is not collected in the storage cylinder 68 and also traps any iodine that might pass the dry ice trap 62. A thermocouple pressure gauge 76 is provided in the circuit to effect pressure readings in the milliTorr range, which would allow any problems during transfer to be detected.

The pumping system, comprising the rotary vacuum pump 52 and the diffusion pump 66, is provided with a Penning gauge 78, which monitors the vacuum at the diffusion pump inlet, and is exhausted through the charcoal filter 54. Any radioactivity detected at the filter results in shutdown of the apparatus for investigation of the problem. These elements and procedures ensure complete safety in operation of the equipment.

Figure 3:
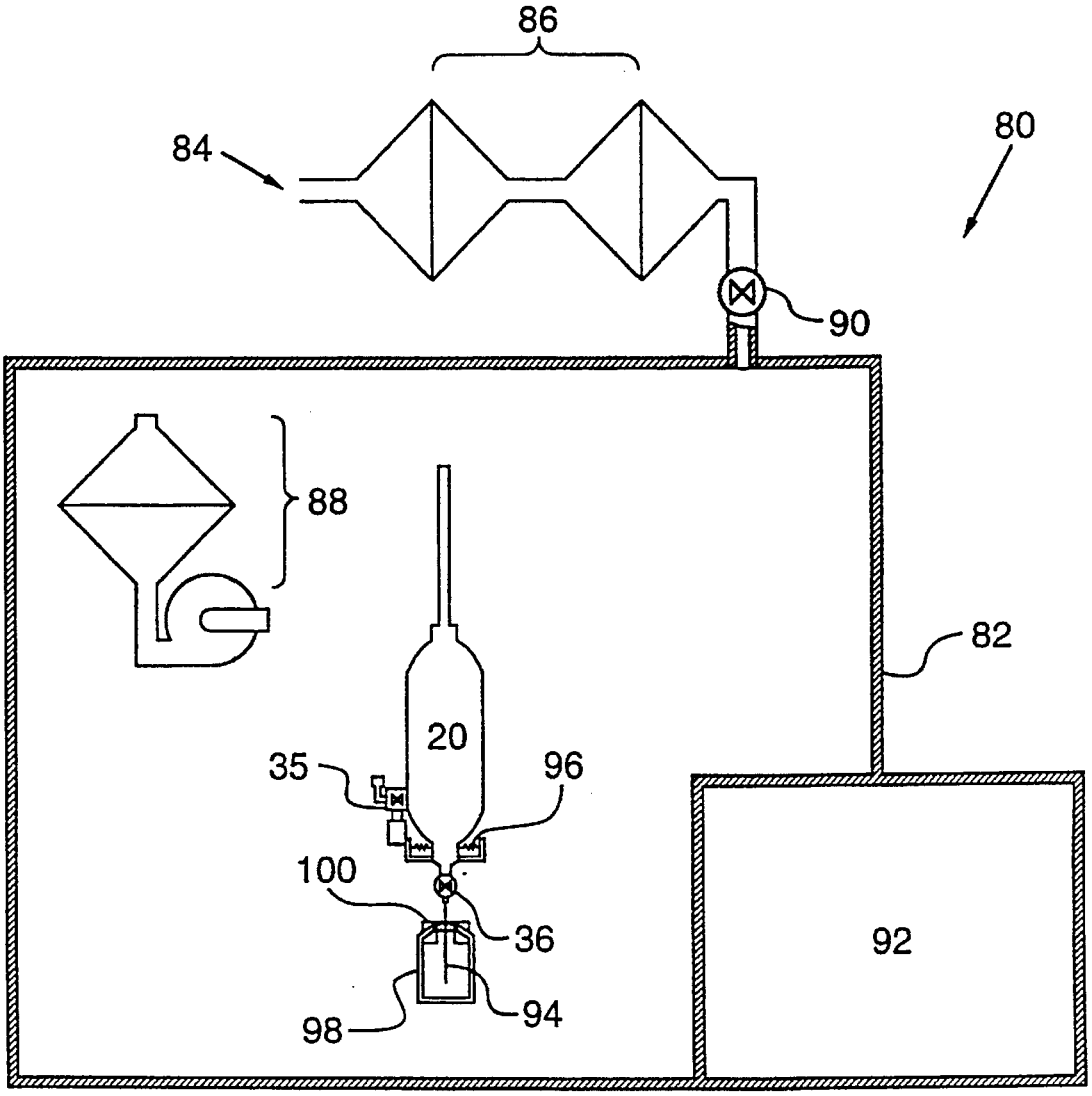
FIG. 3 is a schematic representation of an iodine recovery station utilized in the production of the $^{125}I$.

The iodine recovery station 80 is shown schematically in FIG. 3 and includes an enclosing glove box 82, which provides double encapsulation while iodine is washed from the interior of the decay chamber 20 and transferred to a storage and shipping container. Iodine-125 is readily shielded and ample shielding can be provided, as desired.

The glove box 82 is maintained at a slight negative pressure by connection to a line 84 that vents to the building exhaust system through an activated charcoal filter assembly 86. An internal recirculating blower and filter 88 continuously traps any volatile iodine that may be present in the glove box 82. In the event that a radioactive leak is detected, the exhaust flow is halted by closing the damper 90, thus sealing the glove box 82 pending resolution of the problem. The decay chamber 20 and any other required components are loaded into the glove box 82 through a passthrough 92. Other components indicated in FIG. 3 include a needle fitting 94, which may be attached to the main valved connector 36 of the decay chamber 20, a heater element 96, which is placed in an integral heater cup of the decay chamber 20, and an evacuated vial 98, which includes a rubber septum closure 100.

OPERATION

In operation of the apparatus depicted in FIGS. 1 and 2, the gas-wetted portions of the submersible apparatus 10 initially are evacuated through the main valved connector 36 to the ultimate vacuum of the pumping station comprising the rotary vacuum pump 52 and the diffusion pump 66. Liquid nitrogen is introduced into the lower cryopump cold cell 32 through a supply tube that is inserted coaxially into the filler tube 40.

The desired quantity of $^{124}$Xe from storage cylinder 68 then is admitted to the submersible apparatus 10 through the main valved connector 36. The $^{124}$Xe condenses in the lower cryopump 32. The remotely-activated valves 31, 35 then are closed. Following warming of the lower cryopump 32 with dry air admitted via the supply tube that is within the filler tube 40, the $^{124}$Xe evaporates so that approximately 95% of the $^{124}$Xe fills the irradiation chamber 18.

The main valved connector 36 then is closed and the gas handling and vacuum station 50 is disconnected from the submersible apparatus 10. The upper housing portion 16 then is situated in place and the top cap 46 is installed.

The submersible apparatus 10 then is fully submerged in the reactor pool and positioned with the irradiation chamber 18 adjacent to the reactor core, thus exposing the $^{124}$Xe within the irradiation chamber 18 to the desired neutron flux. The remote location of the decay chamber 20 with respect to the irradiation chamber ensures that the decay chamber is free from neutron flux, which ensures that $^{126}$I is not formed. After the scheduled irradiation time has elapsed, the submersible apparatus 10 is moved away from the core and raised until the top cap 46 is above the level of the reactor pool. The air between the bulkhead 17 and the top cap 46 is sampled through the outer sniffer port 48 to ensure that no leakage of radioactive gas has occurred within the apparatus 10.

The top cap 46 then is removed and the upper cryopump cold cell 34 is filled with liquid nitrogen through a supply tube, which is positioned within the filler tube 42. With the upper cryopump 32 operating, the valves 33, 35 are opened, which causes irradiated xenon to pass via tubes 22, 24 into the condenser portion of the upper cryopump 34, where the condenser portion is integral with the decay chamber 20. The valves 33, 35 then again are closed. Dry air is admitted into the cold cell of the upper cryopump 34 via the supply tube which is within the filler tube 42 to cause evaporation of the condensed irradiated xenon within the decay chamber 20. The top cap 46 then is replaced.

The submersible apparatus 10 then is submerged in the reactor pool for the decay period to provide enhanced safety. Any radiation which might escape the apparatus 10 during that period is contained within the reactor pool. Furthermore, the increased hydrostatic pressure due to submersion greatly decreases the probability of such leakage.

Following the decay period, during which radioactive $^{125}$Xe decays to radioactive $^{125}$I, which deposits on the wall of the decay chamber 20, the submersible apparatus is raised to the surface of the reactor pool and the air again is sampled via the outer sniffer port 48 before removing the top cap 46. The lower cryopump 32 again is started by introducing liquid nitrogen into the cold cell and valves 33, 35 again are open, permitting undecayed xenon to pass from the decay chamber 20 to be condensed in the cryopump 32.

The valves 33, 35 again are closed and the cryopump 32 warmed to cause evaporation of the xenon. The top cap 46 is replaced and the submersible apparatus then is ready for further irradiation. The cycle then is repeated as required to provide the desired quantity of $^{125}$I from the initial feed quantity of $^{124}$Xe. Generally, about three to five cycles are performed per production run of $^{125}$I.

Following the final irradiation and transfer for a production run, the submersible apparatus 10 is left for an extended period submerged in the reactor pool to permit the radioactive xenon to decay by a considerable degree, generally by up to about 90%. The remaining xenon again is condensed by the lower cryopump 32, so that the decay chamber 20 is evacuated of xenon. Following removal of the cap 46, the air inside the submersible apparatus is sampled through the inner sniffer port 38 and, if no radioactive leakage is detected, the submersible apparatus 10 is raised until the upper housing portion 16 is above the reactor pool level.

Next, the upper housing portion 16 is removed. A monitored exhaust flow is provided to collect any radioactive gases that might escape during the period that the double containment is not maintained, with the effluent from such exhaust passing through an activated charcoal filter before being vented to the building exhaust.

The gas-handling and vacuum station 50 then is attached to the main valved connector 36 and the lines evacuated. To verify that the final cryopumping operation with respect to residual xenon was successful, valve 72 is closed and main valved connector 36 opened so that the thermocouple gauge 76 may indicate the pressure within the decay chamber 20. If required, the decay chamber 20 is evacuated through the dry-ice trap 62 and the liquid-nitrogen traps 64 to remove any permanent gases. Following evacuation of any significant quantities of permanent gases, the xenon may be cryopumped back to the irradiation chamber 18 by the procedure described above.

When such pumping is complete, the flexible tube 60 is disconnected from the main valved connector 36, which now is closed, and the two ports that are so exposed are capped. The complete absence of xenon in the decay chamber is confirmed by checking that there is no significant radiation field due to the decay chamber.

If the optional getter trap 31 is present, the integral valve 37 is closed. The extended valve handle 44 is removed from the valve 35, and the decay chamber 20 is detached from the rest of the apparatus 10 at the disconnect between the valves 35 and 37, if the getter trap 31 is included, or between valves 35 and 33, if the getter trap 31 is excluded. The remaining exposed port of the decay chamber 20 and the other port are capped and the decay chamber transported to the iodine recovery station.

A second decay chamber 20 is fitted into the apparatus and the extended valve handle 44 and upper housing portion 16 are replaced. The submersible apparatus 10 then is ready for another production run.

The first decay chamber 20 is moved into the glove box 82 via the passthrough 92, and is secured in an inverted position as shown. A needle fitting 94 is attached to the main valved connector 36 of the decay chamber 20. The needle 94 is pushed through the septum of a large evacuated fill flask (not shown) that contains degassed aqueous sodium hydroxide solution, or other suitable refluxable solvent for $^{125}$I, but is otherwise evacuated. The needle 94 is short relative to the length of the flask, and the volume of the flask is sufficient to greatly decrease the pressure within the needle 94 and main valved connector 36. The decay chamber and fill flask are swivelled through 180° so that the needle 94 is immersed in the sodium hydroxide solution. The main valved connector 36 is opened, allowing the desired amount of sodium hydroxide solution to enter the decay chamber 20, whereupon the main valved connector 36 is closed. The quantity of sodium hydroxide solution admitted is determined initially by reference to calibration marks that are inscribed on the neck of the fill flask, adjacent to the rubber septum, and is verified by before and after mass measurements of the fill flask and its contents.

A heater element 96 is positioned within the integral heater cup of the decay chamber 20 and the heater cup is filled with deionized water. When the heater element 96 is energized, pure water evaporates from the sodium hydroxide solution within the decay chamber 20 and condenses upon all internal surfaces, whereupon the water so delivered dissolves any iodine present before dripping back into the pool of sodium hydroxide solution at the bottom of the decay chamber 20. This refluxing process effects an efficient cleansing of the internal surfaces of the decay chamber 20 and causes the iodine to become dissolved in the aqueous sodium hydroxide solution. Following the completion of the refluxing procedure, heating is discontinued and the lower portion of the decay chamber 20 is actively cooled by placing ice in the integral heater cup of the decay chamber 20, thus causing any remaining water vapour in the volume of the decay chamber 20 to condense in the pool of aqueous sodium hydroxide solution.

An evacuated vial 98 is positioned with the needle 94 penetrating the rubber septum 100 and forming a vacuum tight seal. Upon opening the main valved connector 36, the iodine solution passes from the decay chamber 20 through the needle fitting 94 into the vial, which is shielded with lead. If required, valve 35 can be opened briefly in order to admit air and assist in this operation.

Following the loading of the vial 98 with the iodine solution, the main valved connector 36 and the valve 35 are closed, and the needle 94 is carefully withdrawn from the septum 100, which is self-sealing. The $^{125}$I solution thus is ready for assaying, subdivision, outer packaging and shipment.

The needle 94 then is detached from the empty decay chamber 20 which then is completely evacuated using the gas-handling and vacuum station 50 in order to remove all traces of moisture. Any iodine not transferred to the vial remains in the decay chamber 20 in a non-volatile state. The dried and evacuated first decay chamber 20 then is ready to be exchanged with the second decay chamber 20 for the following production run.

It will be apparent from the above description of the construction and operation of the submersible apparatus in the production of $^{125}$I from $^{124}$Xe that the procedure is effected in a highly safe manner and by a procedure whereby the $^{125}$I is obtained substantially free from $^{126}$I. The materials of construction generally are aluminum and stainless steel and provide a double containment environment against leakage of $^{125}$Xe and/or $^{125}$I at all stages of the procedure, except during the decay chamber interchange. During the latter operation, the xenon is confined to the irradiation chamber and a monitored exhaust flow is provided in the vicinity of the coupling to protect the operator.

The 35 keV gamma radiation from the $^{125}$I is relatively easy to shield, since a 1/10th value layer of lead for 35 keV gammas is only 0.1 mm. The 4 mm stainless steel walls of the decay chamber decrease the radiation fields due to $^{125}$I by a factor of $10^{11}$.

While radiation from $^{125}$Xe is more penetrating, any portion of the apparatus which contains significant amounts of $^{125}$Xe is always well below the surface of the reactor pool and hence is effectively shielded.

At the iodine-recovery station 80, the double containment is provided by the glove box 82.

SUMMARY OF THE DISCLOSURE

In summary of this disclosure, the present invention provides a novel method of producing radioactive $^{125}$I from $^{124}$Xe in a safe and effective manner in a novel double-contained apparatus. Modifications are possible within the scope of this invention.

What we claim is:

1. A method of producing radioactive $^{125}$I, which comprises:

providing a moveable elongate enclosure having therein a lower irradiation chamber and an upper decay chamber connected in fluid flow relationship and in fixed position relationship with the lower irradiation chamber, feeding $^{124}$Xe from a source thereof exterior to said elongate enclosure to said irradiation chamber, positioning said moveable elongate enclosure adjacent to a light water nuclear reactor core submerged in a pool for irradiating said $^{124}$Xe in said irradiating chamber with neutrons to cause the formation of $^{125}$Xe therefrom, transferring irradiated gas by pumping from said irradiation chamber to said decay chamber free from neutron flux, and transferring said moveable elongate enclosure to a submerged location in said pool remote from said remote core and free from neutron flux for permitting $^{125}Xe$ to decay to form $^{125}I$ in said decay chamber.

2. The method of claim 1 wherein said feeding of $^{124}Xe$ to said irradiation zone is effected by:

connecting said source of $^{124}Xe$ to a feed inlet in selectable fluid flow communication wish said irradiation chamber and with a first condensation chamber in said enclosure and flowing said $^{124}Xe$ through said feed inlet, condensing the feed $^{124}Xe$ in said first condensation chamber and closing said feed inlet, and evaporating the liquid $^{124}Xe$ from the first condensation chamber to said irradiation chamber.

3. The method of claim 1 wherein said irradiated gas transfer is effected by condensing irradiated gas flowing between said irradiation chamber and said decay chamber in a second condensation chamber in said enclosure in fluid flow communication with said decay chamber, terminating fluid flow communication between said irradiation chamber and said decay chamber, and evaporating condensed irradiated gas from said second condensation chamber into said decay chamber.

4. The method of claim 3 wherein, following decaying of irradiated gas, the residual gas is transferred to said irradiation chamber by:

condensing residual gas flowing between said decay chamber and said irradiation chamber in said first condensation chamber in said enclosure, terminating fluid flow communication between said irradiation chamber and said decay chamber, and evaporating condensed gas from said first condensation chamber into said irradiation chamber, and said steps of irradiating, transfer of irradiated gas and permitting decay are repeated.

5. The method of claim 1 wherein, following formation of $^{125}I$, said decay chamber is removed from said enclosure for the recovery of $^{125}I$ therefrom.

6. The method of claim 5 wherein said $^{125}I$ is recovered from said decay chamber by introducing an aqueous solvent for $^{125}I$ to the decay chamber, affecting a reflux of said aqueous solvent within said decay chamber to remove solid $^{125}I$ from internal surfaces of said decay chamber and to form an aqueous solution of the iodine solution, and removing said aqueous solution from said decay chamber.

7. The method of claim 6 wherein said aqueous solvent is an aqueous sodium hydroxide solution.

* * * * *